US005603637A

United States Patent [19]

Matsuoka et al.

[11] Patent Number: 5,603,637

[45] Date of Patent: Feb. 18, 1997

[54] WATERPROOF PLUG STRUCTURE

[75] Inventors: Hiroyuki Matsuoka; Eiji Saijo; Shinichi Yamada; Takatoshi Katsuma, all of Yokkaichi, Japan

[73] Assignee: Sumitomo Wiring Systems, Ltd., Yokkaichi, Japan

[21] Appl. No.: 509,062

[22] Filed: Jul. 31, 1995

[30] Foreign Application Priority Data

| | | | |
|---|---|---|---|
| Aug. 4, 1994 | [JP] | Japan | 6-204434 |
| Aug. 8, 1994 | [JP] | Japan | 6-207967 |
| Sep. 26, 1994 | [JP] | Japan | 6-257513 |

[51] Int. Cl.[6] ..... H01R 13/40

[52] U.S. Cl. ..... 439/587

[58] Field of Search ..... 439/274, 275, 439/587–589

[56] References Cited

U.S. PATENT DOCUMENTS

| | | | |
|---|---|---|---|
| 4,643,506 | 2/1987 | Kobler | 439/587 X |
| 5,224,875 | 7/1993 | Watanabe et al. . | |
| 5,231,250 | 7/1993 | Moulton . | |
| 5,527,188 | 6/1996 | Ohtaka et al. | 439/587 X |

FOREIGN PATENT DOCUMENTS

| | | |
|---|---|---|
| 0599329 | 6/1994 | European Pat. Off. . |
| 62-163879 | 10/1987 | Japan . |
| Y2-2-22940 | 6/1990 | Japan . |
| 5-2382 | 1/1993 | Japan . |

*Primary Examiner*—Khiem Nguyen
*Attorney, Agent, or Firm*—Oliff & Berridge

[57] ABSTRACT

A wire insertion hole is formed through a rubber plug along an axis thereof, and the rubber plug has a portion having outer seal lips formed on an outer peripheral surface thereof, and a fixing region to which a metal terminal is clamped. The fixing region includes a clamping region to be clamped by an insulation barrel of the metal terminal, and a withdrawal prevention region. An annular groove is formed in the inner surface of the wire insertion hole at a position corresponding to a boundary portion between the clamping region and the withdrawal prevention region. When the insulation barrel is clamped, the withdrawal prevention region is forcibly flared to be engaged with the metal terminal, thereby preventing the rubber plug from being withdrawn.

6 Claims, 8 Drawing Sheets

WATERPROOF PLUG STRUCTURE

BACKGROUND OF THE INVENTION

1. Field of the Invention

This invention relates to a rubber plug used in a connector required to have a waterproof effect, and also to a withdrawal prevention structure for preventing the rubber plug from being easily disengaged from a metal terminal.

2. Conventional Art of the Invention

A conventional rubber plug of this type is shown in FIG. 1. As shown in this Figure, the rubber plug 40 is fitted on a front end portion of a sheath of a wire 41, and is fixedly clamped to the wire by a metal terminal 42, and in this condition the rubber plug is inserted into a cavity in a connector housing. The rubber plug 40 has a cylindrical shape as a whole, and has a wire insertion hole 43 extending therethrough along an axis thereof, and the wire 41 can be passed through this hole 43 in a sealed manner. Two annular seal lips 44 are formed on an outer peripheral surface of the rubber plug 40 at a rear portion thereof, and a clamping region 46 to be clamped by an insulation barrel 45 of the metal terminal 42 is provided at a front end portion of the rubber plug.

The force of clamping between the rubber plug 40 and the metal terminal 42 is provided by a clamping force applied by the insulation barrel 45, and therefore the withdrawal of the rubber plug 40 can be prevented merely by increasing the clamping force. However, if the clamping force is merely increased, end edges of the insulation barrel 45 bite the rubber plug 50 to such an extent that the rubber plug 40 may be damaged if the end edge of the insulation barrel 45 is formed into a sharp edge. In such a case, the sealing property would be adversely affected. Therefore, it is not proper to merely increase the clamping force. Despite this, the above type is not provided with any withdrawal prevention means, and therefore is not satisfactory from the viewpoint of withdrawal prevention.

To deal with this problem, there has been developed a rubber plug 30 shown in FIG. 2. This rubber plug 30 includes a waterproof portion 31 and a clamping portion 32, and has a tubular shape as a whole, the rubber plug 30 having an insertion hole 33 formed therethrough along its axis for passing a wire W therethrough. Two ribs 34 are formed on an outer peripheral surface of the waterproof portion 31, and can be elastically deformed into intimate contact with an inner peripheral surface of a cavity (not shown), thereby preventing water from introducing into the cavity. A metal terminal T shown in FIG. 4 is attached to the clamping portion 32, and the clamping portion 32 is smaller in outer diameter than the waterproof portion 31. A barrel B, formed at a rear end of the metal terminal T, is compressively clamped to the outer periphery of the clamping portion 32. When the barrel B is thus clamped to the clamping portion 32, the metal terminal is disposed at a right side (FIG. 2) of the rubber plug 30, and the wire W, fixedly connected to the rear end portion of the metal terminal, passes through the insertion hole 33, and extends outwardly from the rubber plug 30 left (FIG. 2).

A flange-like withdrawal prevention portion 35 is formed on a distal end (right end in FIG. 2) of the clamping portion 32 remote from the waterproof portion 31 over an entire periphery thereof. This withdrawal prevention portion 35 serves to prevent the barrel B from being disengaged from the clamping portion 32 when inserting the rubber plug 30, together with the metal terminal, into the cavity.

When the rubber plug 30 of the above construction is to be inserted into the cavity, the metal terminal mounted on the right side (FIG. 2) of the rubber plug 30 is directed toward the cavity, and then the rubber plug is inserted, together with the metal terminal, into the cavity. This inserting operation is carried out by first holding the rubber plug 30 by the fingers and by pushing the rear end of the rubber plug. If it is necessary to insert the rubber plug 30 to a deeper position in the cavity even after the rubber plug 30 is fully received in the cavity, the exposed portion of the wire W, extending outwardly from the rubber plug 30 and disposed outwardly of the cavity, is held by the fingers, and is pushed toward the cavity.

At this time, the wire W is advanced, together with the metal terminal, into a deeper position in the cavity whereas the rubber plug 30 can not advance easily because of a frictional resistance between the rubber plug and an inner surface of the cavity. Therefore, there is a fear that the barrel B tends to be displaced relative to the clamping portion 32 toward the front end (right end in FIG. 2) of the rubber plug. The barrel B, if thus displaced toward the front end, abuts the withdrawal prevention portion 35 (see FIG. 3), and therefore is prevented from further displacement, thereby preventing the barrel B from being disengaged from the clamping portion 32. Thereafter, the rubber plug 30 and the metal terminal, held in a condition shown in FIG. 3, are inserted in unison in the cavity.

Furthermore, there has been proposed a rubber plug 50 in Japanese Utility Model Unexamined Publication No. 62-163879 as shown in FIG. 5. In this rubber plug 50, an annular projection 52 is formed on a surface of a wire insertion hole 51 at a front end thereof, so that the inner diameter of the wire insertion hole 51 is made smaller at the projection 52 than the outer diameter of a wire 53 to be inserted into the insertion hole 51. With this arrangement, a front end of the rubber plug 50 is forcibly bulged when the wire 53 is passed therethrough, and this bulged end is engaged with an insulation barrel as shown in FIG. 6. As a result, the rubber plug 50 is prevented from withdrawal.

However, in the structure shown in FIG. 2 in which the withdrawal prevention portion 35 is merely provided in a projected manner, when the frictional resistance between the rubber plug 30 and the inner surface of the cavity becomes so large that a pressing force acting from the barrel B on the withdrawal prevention portion 35 exceeds a limit value, the barrel B elastically deforms and bends the withdrawal prevention portion 35 right (FIG. 3). At the same time, the barrel B gradually squeezes the withdrawal prevention portion 30 to pass past the same. As a result, in some cases, the barrel B has been disengaged from the clamping portion 32, thus losing the function of retaining the barrel B.

Furthermore, the rubber plug structure shown in FIG. 5 has the following problem to be solved. Because of the provision of the annular projection on the surface of the wire insertion hole, the inner diameter of the wire insertion hole is constricted, so that the wire can not be easily passed therethrough. Therefore, the wire insertion operation is rather troublesome, and can not be carried out efficiently.

The rubber plug must also meet the sealing requirement. For example, in the rubber plug 40 shown in FIG. 1, sealing engagement of the rubber plug 40 with the housing is achieved by the seal lips 44, and the plug 31 also have inner lips 47 for sealing contact with the wire. Even in the type of rubber plug having such inner lips 37, if the wire 41 is pulled, a gap develops between the inner surface of the wire insertion hole 43 and the wire 41, thus adversely affecting the sealing property.

SUMMARY OF THE INVENTION

The present invention has been made in view of the above problem, and an object of the invention is to provide a rubber plug, as well as a rubber plug withdrawal prevention structure, which will positively prevent withdrawal of the rubber plug and will maintain a sealing property.

To achieve the above object, according to the first aspect of the invention, there is provided a rubber plug comprising a wire insertion hole formed through the rubber plug along an axis thereof for passing a sheathed wire therethrough; annular seal lips formed on an outer peripheral surface of the rubber plug; a clamping region for being clamped by an insulation barrel of a metal terminal; and a withdrawal prevention region disposed outwardly of the clamping region for engagement with the insulation barrel to thereby prevent withdrawal of the rubber plug; wherein an annular thinned portion is formed at an inner surface of the wire insertion hole at a position corresponding to a boundary portion between the clamping region and the withdrawal prevention region, the thinned portion allowing the withdrawal prevention region to be forcibly deformed in a flared manner in accordance with the clamping of the insulation barrel.

In the structure of the first aspect of the invention, the wire is passed through the wire insertion hole, and then the clamping region is clamped by the insulation barrel of the metal terminal. At this time, the clamping force acts on the thinned portion to forcibly deform the withdrawal prevention portion in a flared manner. The withdrawal prevention portion thus flared engages the end of the insulation barrel, thereby fixing the rubber plug against withdrawal. Since no projection is formed on the inner surface of the wire insertion hole, the wire insertion operation can be carried out smoothly. And besides, since the forcibly-flared withdrawal prevention portion can be positively engaged with the insulation barrel, the withdrawal prevention effect is enhanced. Furthermore, since the withdrawal prevention portion can be deformed in a flared manner in accordance with the clamping operation, there is required only such a clamping force as to achieve this deformation, and therefore damage to the rubber plug is prevented.

According to the second aspect of the invention, there is provided a rubber plug withdrawal prevention structure comprising a wire insertion hole formed through the rubber plug along an axis thereof for passing a sheathed wire therethrough; annular seal lips formed on an outer peripheral surface of the rubber plug; a clamping region for being clamped by an insulation barrel of a metal terminal; and a withdrawal prevention region disposed outwardly of the clamping region for engagement with the insulation barrel to thereby prevent withdrawal of the rubber plug; wherein a projection is formed on the insulation barrel in facing relation to the rubber plug; and in accordance with the clamping of the insulation barrel, the projection applies a clamping force to a thinned portion formed at an inner surface of the wire insertion hole at a position corresponding to a boundary portion between the clamping region and the withdrawal prevention region, thereby forcibly deforming the withdrawal prevention region in a flared manner.

In the structure of the second aspect of the invention, when the insulation barrel is clamped, the projection is pressed against the thinned portion, so that the amount of flaring or deformation of the withdrawal prevention portion is larger by an amount corresponding to the dimension of radial extension of the projection. Thus, the withdrawal prevention effect is enhanced.

According to the third aspect of the invention, a sealing rubber plug, having a wire insertion hole formed therethrough along an axis thereof, is fixed by clamping an insulation barrel of a metal terminal thereto; in that an annular projected edge is formed on that surface of the insulation barrel facing the rubber plug; and when the insulation barrel is clamped, the projected edge causes that portion of an inner peripheral surface of the wire insertion hole corresponding to the projected edge to bulge inwardly to thereby form an inner seal lip between the rubber plug and a wire.

In the above construction, the wire is passed through the wire insertion hole in the rubber plug, and then the rubber plug is clamped by the insulation barrel, so that the projected edge compresses the localized portion of the rubber plug in an annular manner. As a result, the rubber plug is prevented for withdrawal. That portion of the inner peripheral surface of the wire insertion hole corresponding to that portion of the rubber plug compressed by the projected edge bulges inwardly in an annular manner, thereby forming the inner seal lip contacting the wire. Since the clamping is effected by the projected edge, and sharp end edges of the insulation barrel will not bite the rubber plug, thus protecting the rubber plug from damage. And besides, the rubber plug is locally subjected to the compressive force to form the inner seal lip contacting the wire, and thus the additional seal portion is provided, thereby securing a more positive seal between the rubber plug and the wire.

According to the fourth aspect of the invention, there is provided a rubber plug including an insertion hole for passing a wire therethrough, and a clamping portion extending from a front end of a waterproof portion, wherein the rubber plug is secured to a metal terminal by mounting a barrel, provided at a rear end of the metal terminal connected to the wire, around the clamping portion; and the rubber plug is inserted into a cavity in a connector, with a front end thereof first introduced into the cavity, thereby achieving a waterproof effect in the cavity; in that a withdrawal prevention portion for retaining the barrel is formed on an outer periphery of the clamping portion at a front end thereof, and projects radially outwardly; and an inturned portion extends from a distal end of the withdrawal prevention portion in overhanging relation to a barrel clamping section of the clamping portion, the inturned portion being curved along the outer periphery of the clamping portion.

In the rubber plug of the fourth aspect of the invention, when a force tending to disengage the barrel and the rubber plug from each other is applied, this force tends to deform and bend the withdrawal prevention portion; however, in the invention, since the inturned portion extends from the withdrawal prevention portion, the inturned portion is subjected to a pulling force, and is deformed. At this time, a restoring force of the inturned portion acts in combination with a restoring force of the withdrawal prevention portion, and therefore the withdrawal prevention portion is less liable to be elastically deformed by the addition of the restoring force of the inturned portion. Therefore, the barrel is prevented from passing over the withdrawal prevention portion.

DETAILED DESCRIPTION OF PREFERRED EMBODIMENTS

First Embodiment

A first preferred embodiment of the present invention will now be described with reference to FIGS. 7 to 9.

Figure 9:
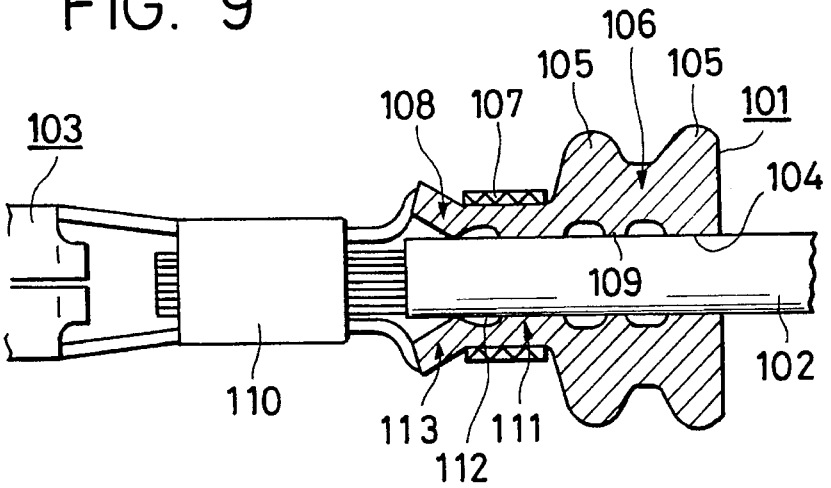
FIG. 9 is a cross-sectional view of the rubber plug in its used condition.

As shown in FIG. 9, a rubber plug 101 of this embodiment is fitted on a front end portion of a sheath of a wire 102, and is fixedly clamped to the wire by a metal terminal 103, and in this condition the rubber plug is inserted into a cavity of a connector (not shown), thereby preventing water from intruding into the connector, thus achieving a waterproof effect.

First, the rubber plug 101 will now be described in detail. The rubber plug 101 has a cylindrical shape as a whole, and is of an integrally-molded construction. The rubber plug 101 has a wire insertion hole 104 extending therethrough along an axis thereof, and the sheathed wire 102 can be passed through this wire insertion hole 104. One open end (right end in FIG. 8) of the wire insertion hole 104 is flaring like a bell of a trumpet to facilitate the insertion of the sheathed wire 102 into this insertion hole.

Figure 1:
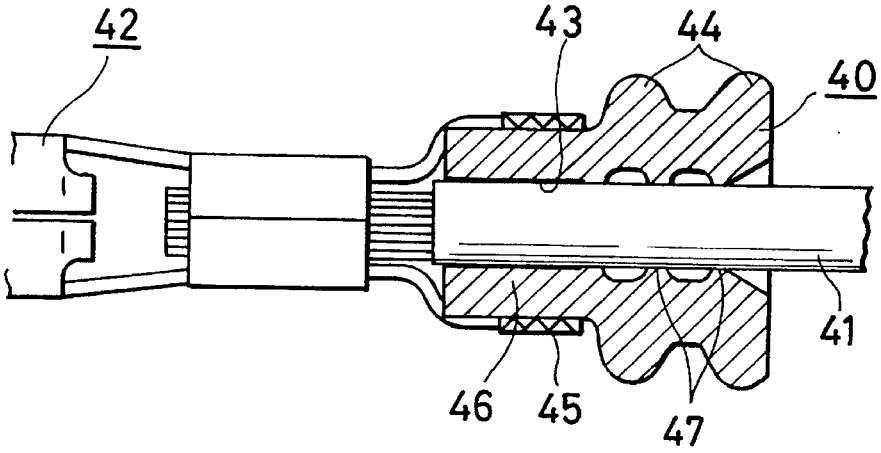
FIG. 1 PRIOR ART
FIGS. 1, 2, 3 are a cross-sectional views of a conventional rubber plugs.
Figure 2:
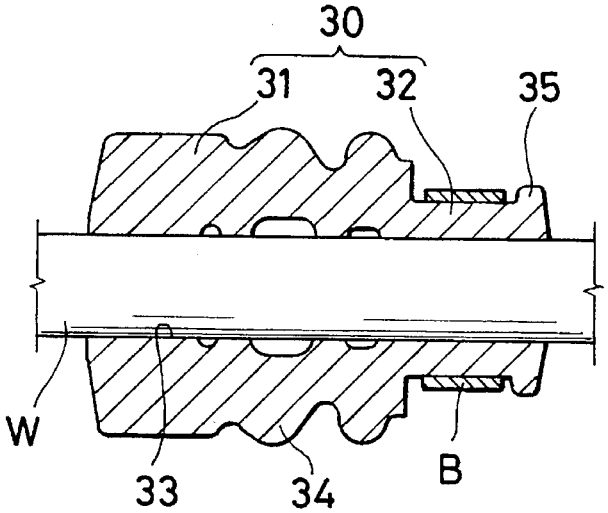
FIG. 2 PRIOR ART
Figure 3:
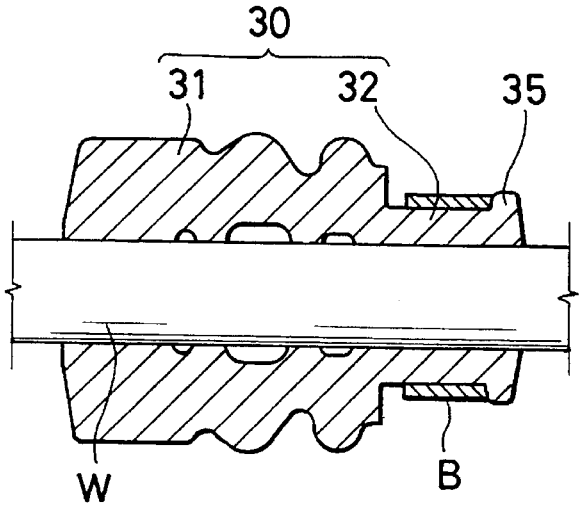
FIG. 3 PRIOR ART
Figure 4:
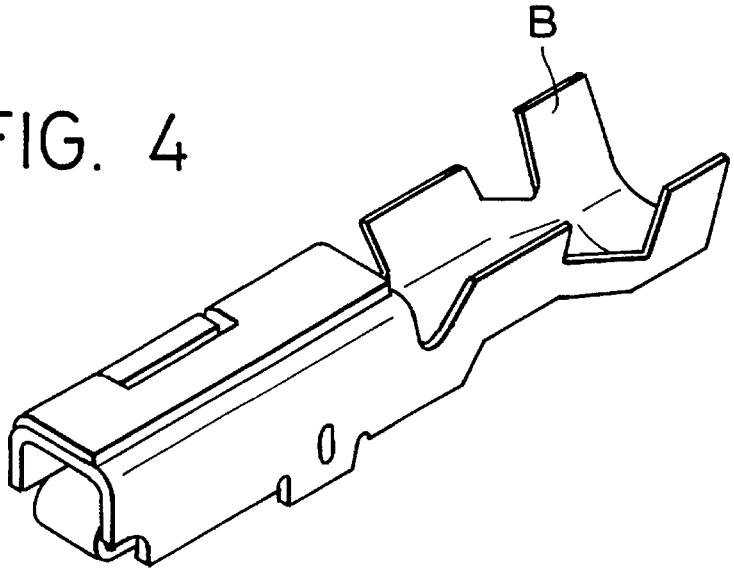
FIG. 4 is a perspective view of a metal terminal.
Figure 5:
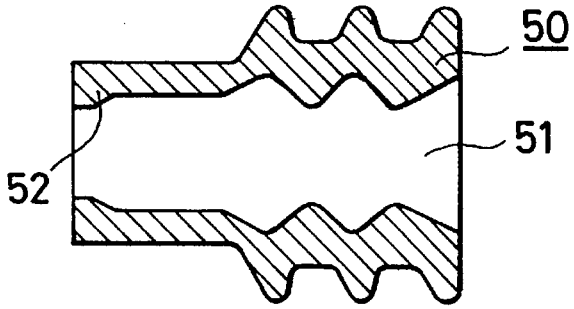
FIG. 5 PRIOR ART
FIGS. 5 is a cross-sectional views of another conventional rubber plug.
Figure 6:
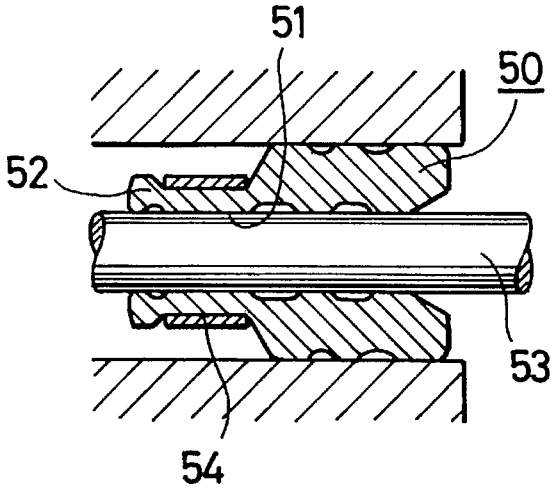
FIG. 6 PRIOR ART
FIG. 6 is a cross-sectional view of the conventional rubber plug of FIG. 5 in its used condition.
Figure 7:
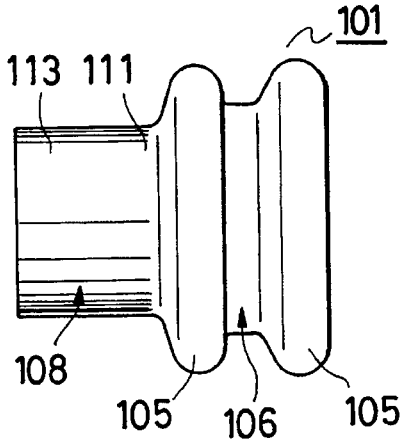
FIG. 7 is a side-elevational view of a first embodiment of a rubber plug of the invention.
Figure 8:
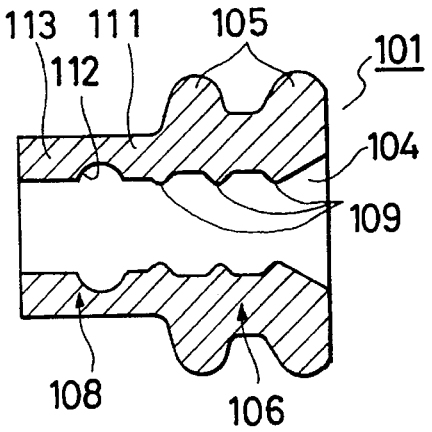
FIG. 8 is a cross-sectional view of the rubber plug.

As shown in FIG. 7, a right half of the rubber plug 101 provides a seal region 106 having two outer seal lips 105 formed on an outer peripheral surface thereof, while a left half thereof provides a fixing region 108 to which an insulation barrel 107 of the metal terminal 103 is to be fixed. The seal region 106 is greater in thickness than the fixing region 108 (see FIG. 8). The two outer seal lips 105 are annular, and are spaced a suitable distance from each other, and extend around the entire outer periphery of the seal region 106. When the wire 102, together with the rubber plug 101, is inserted into the cavity, the two seal lips 105 contact the inner surface of the cavity watertight in a compressed manner. Three inner seal lips 109 are formed on an inner peripheral surface of that portion of the wire insertion hole 104 provided at the seal region 106. That inner seal lip 109 closest to the above open end is continuous with the above flared opening, and the three inner seal lips 109 are spaced at predetermined intervals in that region extending from said that inner seal lip 109 to the fixing region 108. The inner seal lips 109 are annular, and extend over the entire inner periphery of the seal region 106, and can contact the sheathed wire 102 watertight in a compressed manner.

The fixing region 108, unlike the seal region 106, has a cylindrical configuration with no projection, and is clamped by the metal terminal 103 so that the rubber plug will not accidentally be displaced relative to the sheathed wire 102. The metal terminal 103 is of the well known type, and although partially shown in the drawings, the metal terminal 103 includes a connection portion formed at its front end for connection to a mating metal terminal, a wire barrel 110 disposed rearwardly of this connection portion for clamping an exposed portion of a conductor of the sheathed wire 102, and the insulation barrel 107 disposed rearwardly of the wire barrel. The insulation barrel 107 extend substantially perpendicularly to the axis of the metal terminal 103, and is symmetrical with respect to this axis. The insulation barrel 107 has a sufficient length to fully embrace the entire outer periphery of the fixing region 108. A width of the fixing region 108 (that is, a length thereof in the direction of the axis of the metal terminal 103) is sufficiently larger than the width of the insulation barrel 107. The insulation barrel 107 is disposed adjacent to the seal region 106, and is clamped as shown in FIG. 9 (Hereinafter, that portion of the fixing region 108 to be clamped by the insulation barrel 107 will be referred to as "clamping region 111"). An annular groove 112 (thinned portion) is formed in the inner surface of the wire insertion hole 104 at a position corresponding to a boundary portion between the clamping region 111 and the remainder of the fixing region 108. This annular groove 112 extends over the entire inner periphery of the wire insertion hole 104, and one end of the insulation barrel 107 close to the wire barrel 110 is disposed in radial registry with the annular groove 112. With this arrangement, when the rubber plug is clamped by the insulation barrel 107, that portion of the fixing region 108 extending outwardly from the annular groove 112 is forcibly flared, and hence serves as a withdrawal prevention region 113 for preventing the withdrawal of the rubber plug.

The operation of this embodiment of the above construction will now be described specifically. The wire 102 is passed through the wire insertion hole 104, and the rubber plug 101 is positioned on the front end portion of the wire 102. Then, the conductor of the wire is clamped by the wire barrel 110, and the rubber plug 101 is clamped by the insulation barrel 107. More specifically, when the clamping is effected with the one end of the insulation barrel 107 disposed around the annular groove 112, this clamping force compressively deforms the annular groove 112. As a result, the withdrawal prevention region 113 is forcibly flared from the annular groove 112 into a bell-like shape. Therefore, the withdrawal prevention region 113 thus flared is engaged with the one end of the insulation barrel 107, thereby preventing the rubber plug 101 from being withdrawn in a right-hand direction (FIG. 7). In this embodiment, even if the insulation barrel 107 is clamped with such a clamping force that the opposite ends of the insulation barrel 107 are not caused to bit the rubber plug, the withdrawal is positively prevented by the forcibly-flared withdrawal prevention region, and therefore damage to the rubber plug 101 is also prevented. As is different from the conventional construction, any special projection is not formed on the inner surface of the wire insertion hole 104, and therefore the wire 102 can be smoothly passed through this hole.

Second Embodiment

A second embodiment of the present invention will now be described with respect to only those portions different from the first embodiment.

Figure 10A:
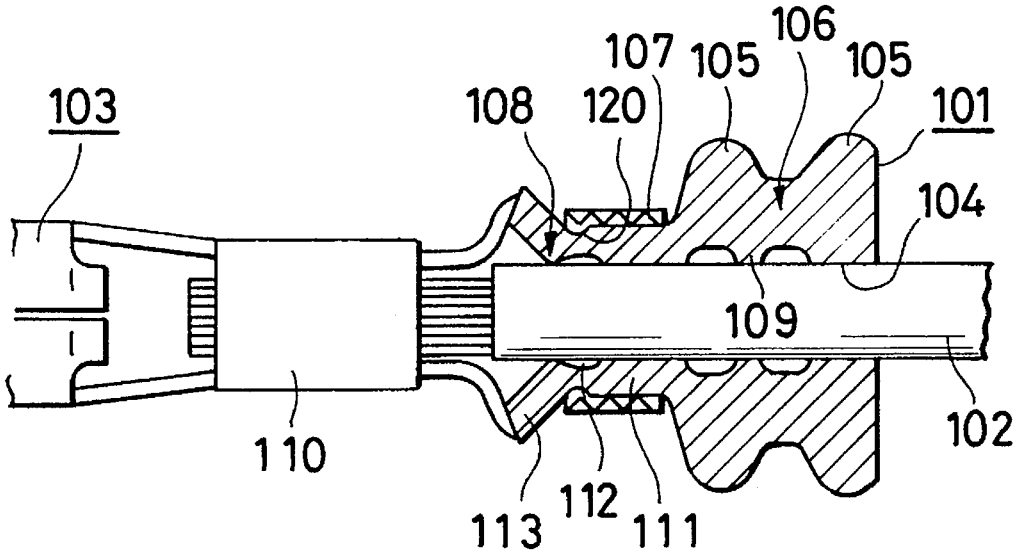
FIG. 10A is a cross-sectional view of a second embodiment of a rubber plug of the invention in its used condition.
Figure 10B:
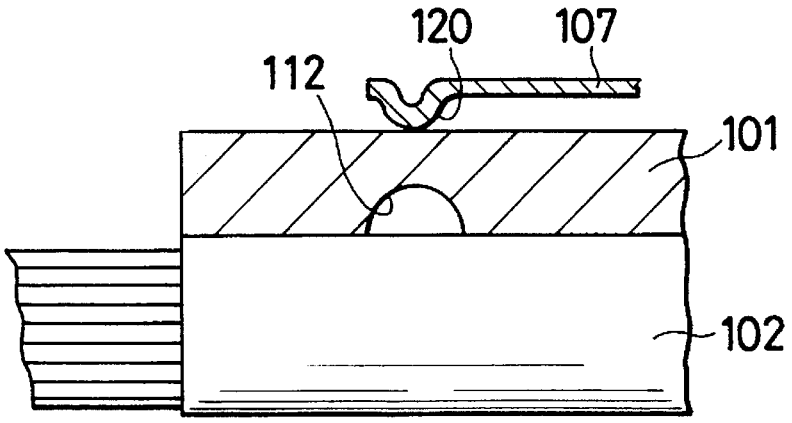
FIG. 10B is a fragmentary, enlarged cross-sectional view showing the second embodiment in a condition before a barrel is clamped.

In the second embodiment, a projection 120 is formed on one end portion (left end portion in FIG. 10A) of an insulation barrel 107, and extends along a length thereof, as shown in FIG. 10B. This projection 120 is formed by stamping the relevant portion of the insulation barrel 107 into a U-shape in a direction to face the rubber plug 101. When the insulation barrel 107 is clamped onto the rubber plug 101 as shown in FIG. 10A, the projection 120 is disposed in radial registry with the annular groove 112.

In the second embodiment of the above construction, because of the radially-inwardly bulged projection 120, the annular groove 112 can be compressively deformed to flare the withdrawal prevention region 113 more easily. Therefore, the rubber plug 101 is more positively prevented from withdrawal, and besides the clamping can be effected with a smaller force. This is effective in reducing the operating force and also in avoiding damage to the rubber plug 101.

In the present invention, it is only necessary to flare the withdrawal prevention region 113 by clamping the clamping region 11, thereby engaging the flared withdrawal prevention region with the end of the insulation barrel 107, and various modifications can be made. For example, the following modifications fall within the scope of the present invention:

The thinned portion is not provided continuously over the entire inner periphery of the wire insertion hole 104, but is provided discontinuously circumferentially.

The projection 120 is not provided continuously over the entire inner periphery facing the rubber plug 101, but is provided discontinuously circumferentially.

Third Embodiment

Figure 11:
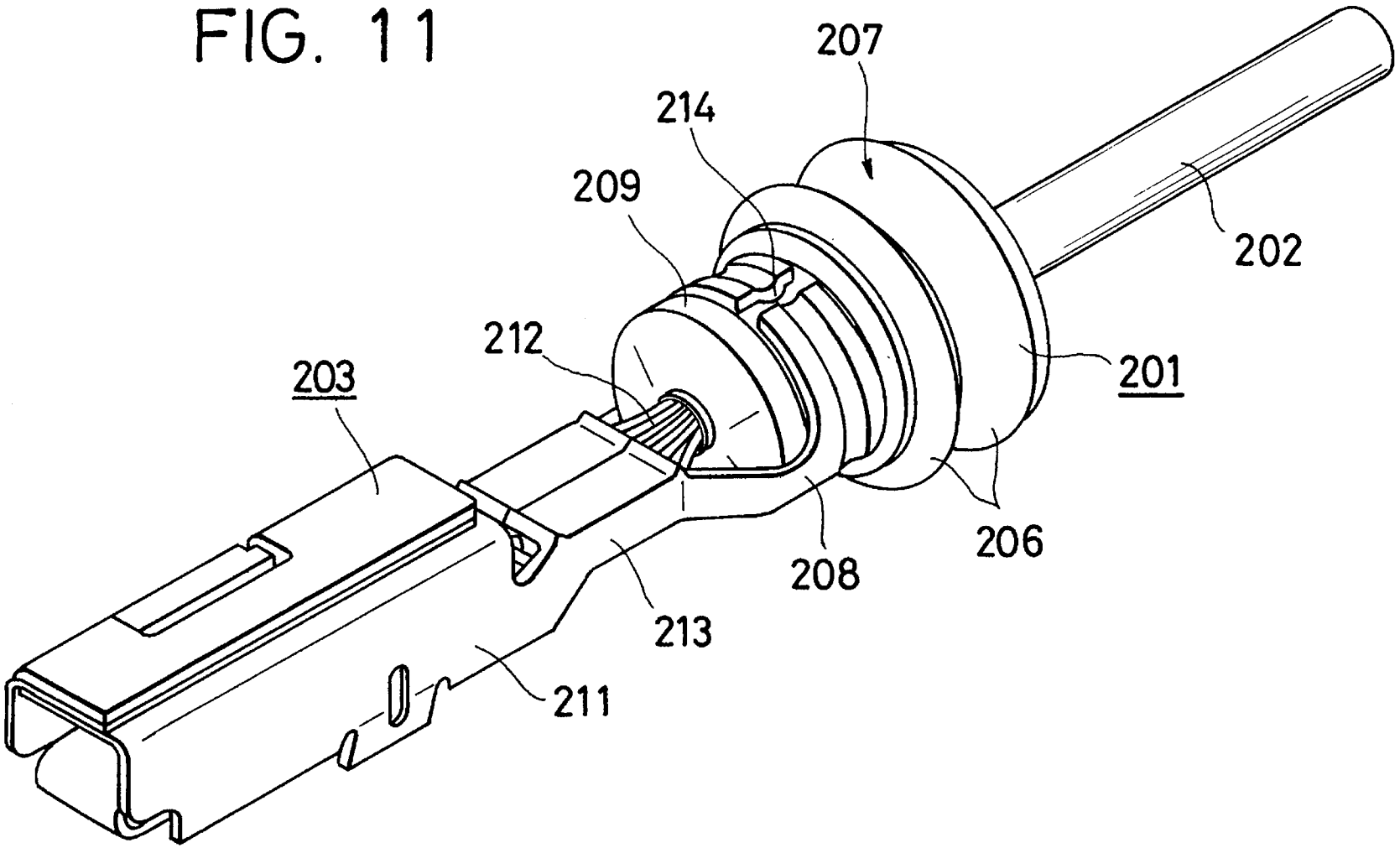
FIG. 11 is a perspective view of a third embodiment of the present invention.
Figure 12A:
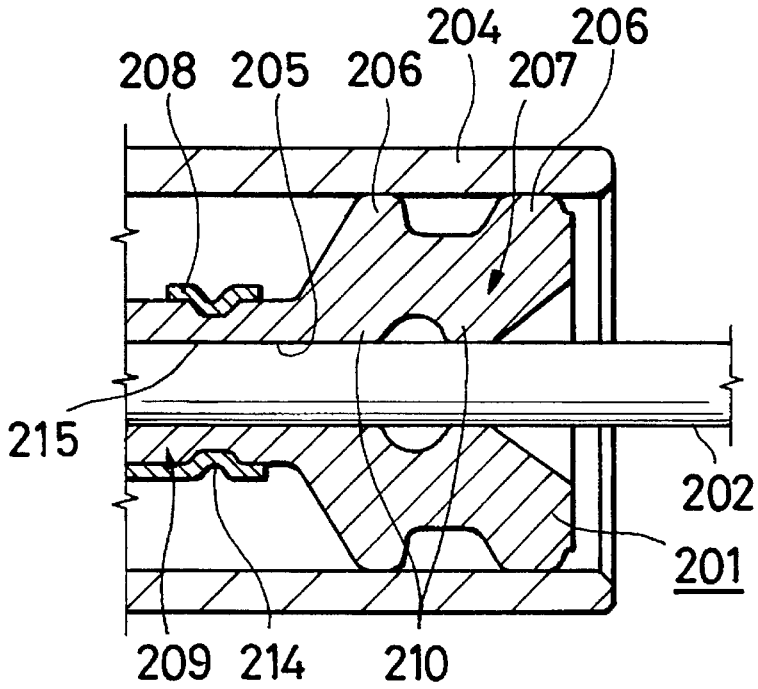
FIG. 12A is a cross-sectional view showing a condition in which a rubber plug is inserted into a connector.

A preferred embodiment of the present invention will now be described in detail with reference to the drawings. As shown in FIG. 11, a rubber plug 201 is fitted on a wire 202, and is disposed at a front end portion of a sheath of the wire 202. Then, the rubber plug 201 is fixedly clamped by a metal terminal 203, and the rubber plug 201 is inserted, together with the wire, into a cavity 204 in a connector as shown in FIG. 12A, so that the rubber plug 201 is held in sealing engagement with an inner surface of the cavity 204 and the wire 202.

First, the rubber plug 201 will now be described in detail. The rubber plug 201 has a cylindrical shape as a whole, and is of an integrally-molded construction. The rubber plug 201 has a wire insertion hole 205 extending therethrough along an axis thereof, and the sheathed wire 202 can be passed through this wire insertion hole 205. One open end (right end in FIG. 12A) of the wire insertion hole 205 is flaring like a bell of a trumpet to facilitate the insertion of the sheathed wire 202 into this insertion hole.

A right half (FIG. 12A) of the rubber plug 201 provides a seal region 207 having two outer seal lips 206 formed on an outer peripheral surface thereof, while a left half thereof provides a fixing region 209 to which an insulation barrel 208 of the metal terminal 203 is to be fixed. The seal region 207 is greater in thickness than the fixing region 209. The two outer seal lips 206 are annular, and are spaced a suitable distance from each other in juxtaposing relation to each other, and extend around the entire outer periphery of the seal region 07. When the wire 202 is inserted, together with the rubber plug 201, into the cavity 204, the two seal lips 206 contact the inner surface of the cavity 204 watertight in a compressed manner.

Inner seal lips 210 are formed on an inner peripheral surface of that portion of the wire insertion hole 205 provided at the seal region 207. That inner seal lip 210 closest to the above open end is continuous with the above flared opening. The inner seal lips 210 are annular, and extend over the entire inner periphery of the seal region 207, and can contact the sheathed wire 202 watertight in a compressed manner.

The fixing region 209, unlike the seal region 207, has a cylindrical configuration with no projection, and is clamped by the metal terminal 203 so that the rubber plug will not accidentally be displaced relative to the sheathed wire 202.

Figure 12B:
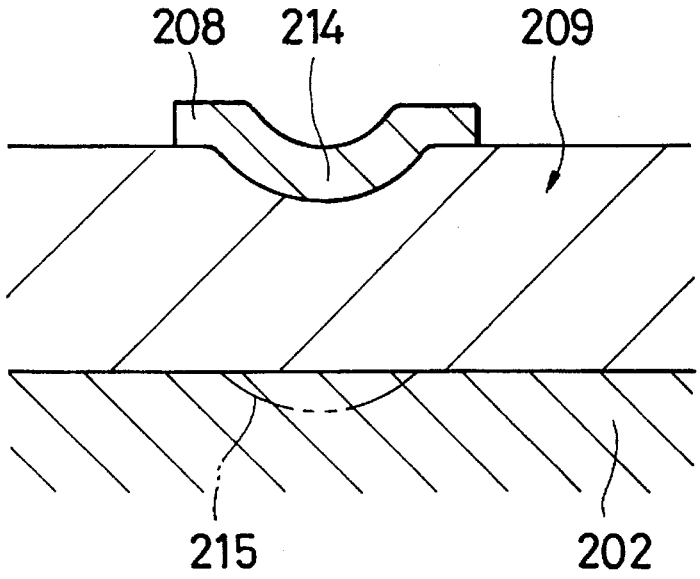
FIG. 12B is an enlarged, cross-sectional view of an important portion of the rubber plug shown in FIG. 12A.

As shown in FIG. 11, the metal terminal 203 includes a connection portion 211 formed at its front end for receiving a mating metal terminal (not shown), a wire barrel 213 disposed rearwardly of this connection portion for clamping an exposed portion of a conductor 212 of the sheathed wire 202, and the insulation barrel 208 disposed rearwardly of the wire barrel. The insulation barrel 208 extend substantially perpendicularly to the axis of the metal terminal 203, and is symmetrical with respect to this axis. The insulation barrel 208 has a sufficient length to fully embrace the entire outer periphery of the fixing region 209. A projected edge 214 is formed on that surface of the insulation barrel 208 to be opposed to the rubber plug 201, and the projected edge 214 projects toward the rubber plug 201, the projected edge 214 being formed by stamping. The projected edge 214 is disposed at a central portion of the insulation barrel 208, and extends over the entire length thereof. The projected edge 214 thus formed by stamping has a semi-circular cross-sectional shape having a gently-curved arcuate surface, as shown in FIG. 12B. Therefore, even when the projected edge 214 bites the outer peripheral surface of the rubber plug 201 upon clamping, it will not damage or cut this outer peripheral surface. When the rubber plug 201 is clamped by the insulation barrel 208, that portion of the inner peripheral surface of the wire insertion hole 205 corresponding to the projected edge 214 bulges inwardly as indicated in a broken line in FIG. 12B, and this bulged portion is compressed more than its neighboring portion, and hence functions as an inner seal portion 215.

In this construction, the wire 202 is passed through the wire insertion hole 205 in the rubber plug 201, and then the conductor 212 is clamped by the wire barrel 213, and the fixing region 209 is clamped by the insulation barrel 208 generally over the entire periphery thereof with a uniform clamping force. As a result, the metal terminal 203 and the rubber plug 201 are fixedly secured to the front end portion of the wire 202. Then, the wire is inserted, together with the rubber plug and the metal terminal, into the cavity 204 in the connector, the outer seal lips 206 form a seal between the inner surface of the cavity 204 and the rubber plug, and also the inner seal lips 210 form a seal between the sheathed wire 202 and the rubber plug.

When the insulation barrel 208 is clamped, the projected edge 214 bites the sheath of the wire 202, so that that portion of the inner peripheral surface of the wire insertion hole 205 corresponding to the projected edge 214 is subjected to its compressive force to bulge into a ring-shape. This bulged portion is pressed against the wire 202 with a larger force than the remainder of the rubber plug, and therefore this bulged portion constitutes the inner seal portion 215 which forms a positive seal between the rubber plug and the sheathed wire. Particularly, the inner seal portion 215 is disposed relatively deep in the cavity 204, and therefore even if the wire 202 is pulled, the inner seal portion 215 is advantageously less affected.

And besides, because of the provision of the projected edge 214, the clamping force is increased, thereby preventing the rubber plug 201 from displacement out of position or withdrawal. Furthermore, since the clamping force is provided mainly by the projected edge 214, the sharp edges of the insulation barrel 208 will not bite the outer peripheral surface of the rubber plug 201. In addition, since the projected edge 214 has the arcuate surface, it will not damage or cut the rubber plug 201. In this respect, also, the sealing effect is maintained.

The present invention can be modified in various ways, and the following modifications will fall within the scope of the present invention.

The projected edge does not always need to have the annular shape, and may be discontinuous at predetermined pitches.

In the illustrated embodiment, although the outer peripheral surface of the wire is held in intimate contact with the inner peripheral surface of the wire insertion hole (that is, the inner peripheral surface of the fixing region) before the insulation barrel is clamped, a slight clearance may be provided between the inner peripheral surface of the wire insertion hole and the wire before the clamping if a seal is formed between the rubber plug and the sheathed wire by the inner seal lip or portion formed by the projected edge upon clamping. In this case, the wire can be easily passed through the rubber plug while enabling the formation of seals at the inner and outer sides of the rubber plug.

Fourth Embodiment

Figure 13:
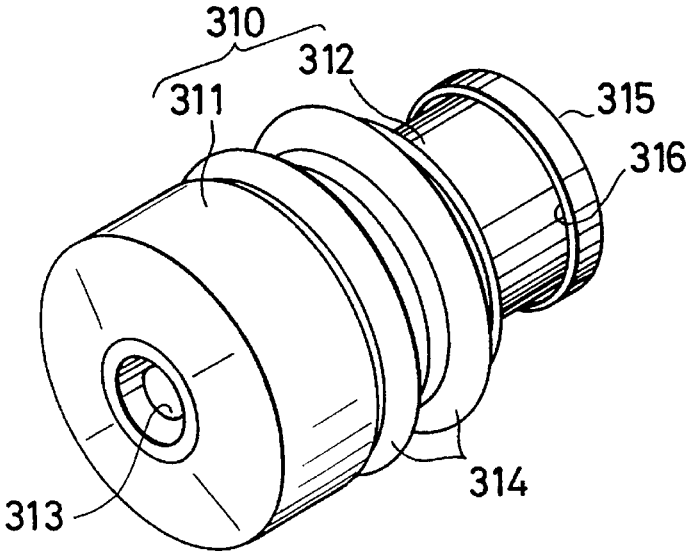
FIG. 13 is a perspective view of a fourth embodiment of the invention.

A fourth embodiment of the present invention will now be described with reference to FIGS. 13 to 15.

A rubber plug 310 of this embodiment includes a waterproof portion 311 and a clamping portion 312, and has a cylindrical shape as a whole, the rubber plug 310 having an insertion hole 313 formed therethrough along an axis thereof. A wire W is adapted to pass watertight through this insertion hole 313.

The waterproof portion 311 has an outer diameter slightly smaller than an inner diameter of a cavity in a connector (not shown). Ribs 314 are formed on an outer periphery of the waterproof portion 311 over an entire periphery thereof, and when the rubber plug 310 is inserted into the cavity, these ribs 314 are elastically deformed into intimate contact with the inner peripheral surface of the cavity, thereby preventing water from intruding from the outside of the connector into the cavity.

A metal terminal of a conventional construction as described above is attached to the clamping portion 312 of the rubber plug 310. The clamping portion 312 extends from a front end surface (right end surface in FIGS. 14 and 15) of the waterproof portion 311 in coaxial relation thereto. The clamping portion 312 is smaller in outer diameter than the waterproof portion 311, and a U-shaped barrel B, formed at a rear end of the metal terminal, is compressively clamped to the outer periphery of the clamping portion 312.

When the barrel B is thus clamped to the clamping portion 312, the metal terminal is disposed at the right side (FIGS. 14 and 15) of the rubber plug 310, and the wire W, fixedly connected to the rear end portion of the metal terminal, passes through the insertion hole 313, and extends outwardly from a rear end surface (left end surface in FIGS. 14 and 15) of the waterproof portion 311.

A peripheral withdrawal prevention portion 315 is formed on an outer surface of a front end of the clamping portion remote from the waterproof portion 311 over an entire periphery thereof, this portion 315 being directed radially outwardly into a flange-like configuration. A dimension of radial projection of this withdrawal prevention portion 315 is larger than the thickness of the barrel B. An axial thickness of the withdrawal prevention portion 315 is generally equal to its radial projection dimension.

A continuous, inturned portion 316 is formed integrally with an outer peripheral portion of the withdrawal prevention portion 315 over an entire periphery thereof. The inturned portion 316 extends from the withdrawal prevention portion 315 in overhanging relation to the barrel clamping portion, and is cylindrical, and is spaced a predetermined distance from the outer peripheral surface of the clamping portion 312 in concentric relation thereto.

The operation of this embodiment will now be described.

The rubber plug 310 of this embodiment is attached to the metal terminal by compressively clamping the barrel B to the clamping portion 312. When the rubber plug 310 is thus attached to the metal terminal, the metal terminal is disposed at the clamping portion side (that is, the right side in FIGS. 14 and 15) of the rubber plug 310.

When the rubber plug 310 and the metal terminal are to be mounted in the cavity, the rubber plug 310 is held by the fingers, with the metal terminal directed toward the cavity, and then they are inserted into the cavity. Therefore, the metal terminal, the clamping portion 312 of the rubber plug 310, and the waterproof portion 311 are introduced sequentially into the cavity in this order.

When the waterproof portion 311 is inserted into the cavity, the ribs 314 on the outer periphery of the waterproof portion 311 are elastically deformed into contact with the inner peripheral surface of the cavity, so that a frictional resistance develops between the rubber plug 310 and the inner peripheral surface of the cavity because of an elastic restoring force of the ribs 314. Therefore, when the waterproof portion 311 begins to be inserted into the cavity, the fingers are held against the end surface of the waterproof portion 311, and the rubber plug 310 is forced into the cavity.

If it is necessary to further advance the rubber plug 310 into a predetermined deeper position in the cavity even after the waterproof portion is completely inserted into the cavity, the exposed portion of the wire W, extending outwardly from the end surface of the waterproof portion 311 of the rubber plug 310 and disposed outwardly of the cavity, is held by the fingers, and is pushed to further advance the rubber plug 310 in the cavity.

Figure 14:
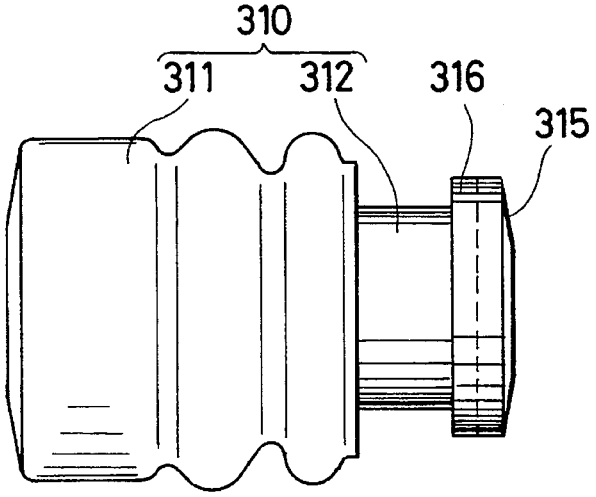
FIG. 14 is a side-elevational view of the fourth embodiment.
Figure 15:
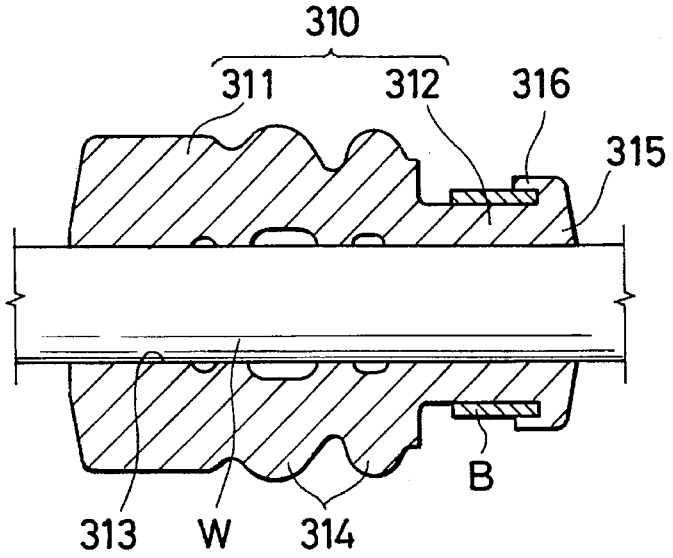
FIG. 15 is a cross-sectional view of the fourth embodiment having a barrel attached thereto.

At this time, if although the wire W advances, together with the metal terminal, into the deeper position in the cavity, the rubber plug 310 can not advance easily because of the frictional resistance between the ribs 314 and the inner surface of the cavity, the barrel B is displaced relative to the clamping portion 312 toward the front end (right end in FIGS. 14 and 15). When the barrel B is thus displaced toward the front end, the barrel B abuts against the withdrawal prevention portion 315 as shown in FIG. 15, and in this condition an axial pressing force is applied from the barrel B to the withdrawal prevention portion 315, and tends to deform and bend this portion 315 forwardly.

In the rubber plug 310 of this embodiment, the withdrawal prevention portion 315 and the inturned portion 316 are both formed over the entire periphery of the clamping portion 312. Therefore, when the withdrawal prevention portion 315 tends to be elastically deformed and bent forwardly, the inturned portion 316 is pulled, and elastically flexed or deformed. At this time, the elastic restoring force of the inturned portion 16 serves as an elastic retaining force to protect the withdrawal prevention portion 315 against the pressing force applied from the barrel B.

Because of the elastic retaining force possessed by the withdrawal prevention portion 315 and the elastic retaining force possessed by the inturned portion 316, the withdrawal prevention portion 315 is made less liable to be elastically deformed and bent forwardly. Therefore, the withdrawal prevention portion 315 is kept engaged with the barrel B, and the barrel B is prevented from passing past the withdrawal prevention portion 315, thus preventing the disengagement of the barrel B from the clamp portion 312.

Therefore, by pushing the wire W, the rubber plug 310 can be inserted, together with the metal terminal, into the deeper position in the cavity, with the barrel B kept retained by the withdrawal prevention portion 315.

Fifth Embodiment

Figure 16:
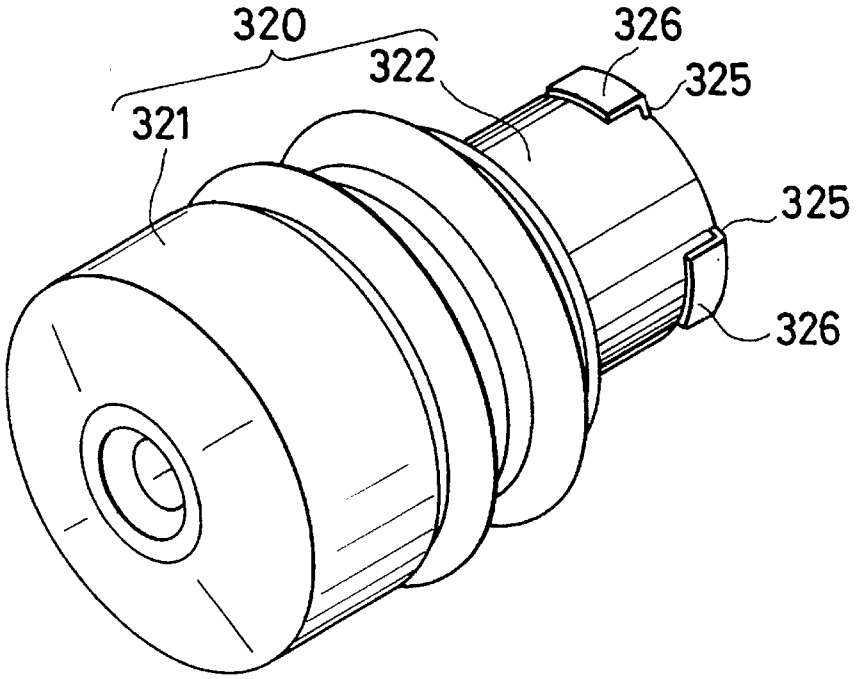
FIG. 16 is a perspective view of a fifth embodiment of the invention.
Figure 17:
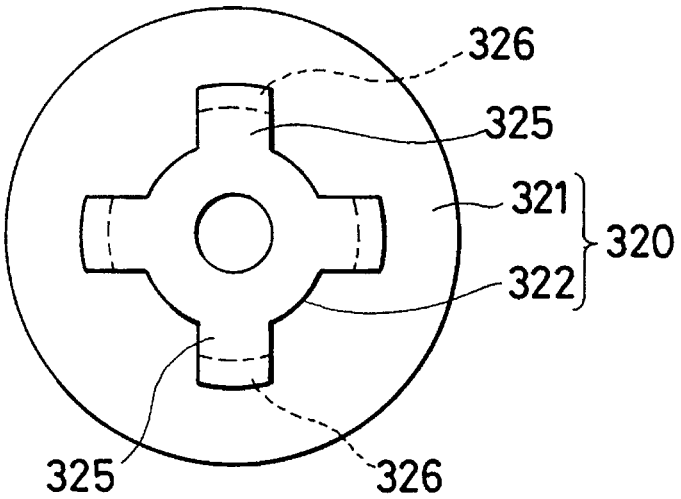
FIG. 17 is a front-elevational view as seen from a clamping portion side.

A fifth embodiment of the present invention will now be described with reference to FIGS. 16 and 17.

A rubber plug 320 of this embodiment differs from the fourth embodiment in that a withdrawal prevention portion, as well as an inturned portion, have a different configuration. Four withdrawal prevention portions 325 projecting radially outwardly are formed on an outer peripheral surface of a front end of a clamping portion 322 remote from a waterproof portion 321, and are circumferentially spaced at predetermined angles (90 degrees) from one another. In this embodiment, the length of each withdrawal prevention portion 325 in the circumferential direction is substantially ⅛ of the outer diameter of the clamping portion 322.

An inturned portion 326 extends from a distal end of each of the withdrawal prevention portion 325 in overhanging relation to the barrel (not shown in FIGS. 16 and 17) clamping portion. The inturned portion 326 is equal to the withdrawal prevention portion 325 in length in the circumferential direction. The inturned portions 326 are arcuately curved, and are disposed on a circle concentric with the clamping portion 322.

The operation of this embodiment will now be described.

In the rubber plug 320 of this embodiment, the inturned portions 326 are arcuately curved, and are disposed on the circle concentric with the clamping portion 322. Therefore, when the withdrawal portions 325 are elastically deformed and bent forwardly, the inturned portions 326 are also elastically flexed or deformed in accordance with the deformation of the withdrawal prevention portion 326. At this time, the elastic restoring force of the inturned portion 326 serves as an elastic retaining force to protect the withdrawal prevention portion 325 against the pressing force applied from the barrel B.

Because of the elastic retaining force possessed by the inturned portion 326 and the elastic retaining force possessed by the withdrawal prevention portion 325, the withdrawal prevention portion 325 will not elastically deformed and bent forwardly by the pressing force applied from the barrel, and therefore the withdrawal prevention portions 325 retain the barrel against disengagement.

The present invention is not to be limited to the embodiments described above with reference to the drawings, and for example, the following modifications fall within the scope of the present invention, and also other modifications than the following can be made within the scope of the invention.

In the above embodiment, although the four withdrawal prevention portions 325 and the four inturned portions 326 are provided, the number thereof may be not more than three, or not less than five. The arrangement of the withdrawal prevention portions and the inturned portions in the circumferential direction, as well as the length thereof in the circumferential direction, may be suitably determined.

In the above embodiment, although the withdrawal prevention portion as well as the inturned portion 316 is formed over the entire periphery of the clamping portion 312, there can be adopted an arrangement in which the withdrawal prevention portion is provided over the entire periphery whereas the inturned portion is interrupted at predetermined intervals in the circumferential direction.

What is claimed is:

1. A waterproof plug comprising:

a wire insertion hole formed through said waterproof plug along an axis thereof for passing a sheathed wire therethrough;

annular seal lips formed on an outer peripheral surface of said waterproof plug;

a clamping region to be clamped by an insulation barrel of a metal terminal;

a withdrawal prevention region disposed outwardly of said clamping region for engagement with said insulation barrel to thereby prevent withdrawal of said waterproof plug; and an annular thinned portion formed at an inner surface of said wire insertion hole at a position corresponding to a boundary portion between said clamping region and said withdrawal prevention region, said thinned portion allowing said withdrawal prevention region to be forcibly deformed in a flared manner in accordance with the clamping of said insulation barrel.

2. A waterproof plug as claimed in claim 1, wherein said waterproof plug is made of rubber.

3. A waterproof plug as claim in claim 1, further comprising a plurality of inner seal lips formed on an inner peripheral surface of said wire insertion hole, the inner seal lips being annular and being able to watertightly contact the sheathed wire in a compressed manner.

4. A structure for preventing a waterproof plug from withdrawing from a metal terminal, said structure comprising:

a wire insertion hole formed through said waterproof plug along an axis thereof for passing a sheathed wire therethrough;

annular seal lips formed on an outer peripheral surface of said waterproof plug;

a clamping region for being clamped by an insulation barrel of a metal terminal;

a withdrawal prevention region disposed outwardly of said clamping region for engagement with said insulation barrel to thereby prevent withdrawal of said waterproof plug;

a projection formed on said insulation barrel in facing relation to said waterproof plug; and a thinned portion formed at an inner surface of said wire insertion hole at a position corresponding to a boundary portion between said clamping region and said withdrawal prevention region, said thinned portion allowing said withdrawal prevention region to be forcibly deformed in a flared manner in accordance with the clamping of said insulation barrel.

5. A structure as claimed in claim 4, wherein said waterproof plug is made of rubber.

6. A structure as claim in claim 4, further comprising a plurality of inner seal lips formed on an inner peripheral surface of said wire insertion hole, the inner seal lips being annular and being able to watertightly contact the sheathed wire in a compressed manner.

* * * * *